US010408585B1

(12) United States Patent
Potter et al.

(10) Patent No.: US 10,408,585 B1
(45) Date of Patent: Sep. 10, 2019

(54) ARCHERY ARROW VANE

(71) Applicant: Bohning Company, Ltd., Lake City, MI (US)

(72) Inventors: Robert L. Potter, McBain, MI (US); Larry R. Griffith, Lake City, MI (US)

(73) Assignee: Bohning Company, Ltd., Lake City, MI (US)

( * ) Notice: Subject to any disclaimer, the term of this patent is extended or adjusted under 35 U.S.C. 154(b) by 0 days.

(21) Appl. No.: 16/201,109

(22) Filed: Nov. 27, 2018

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/586, 578, 585
See application file for complete search history.

(56) References Cited

U.S. PATENT DOCUMENTS 2,887,319 A * 5/1959 Lay ..... F42B 6/06 473/586
3,595,579 A * 7/1971 Benoit ..... F42B 6/06 273/DIG. 12
3,749,623 A * 7/1973 Benoit ..... F42B 6/06 156/187
3,815,916 A * 6/1974 Meszaros ..... F42B 6/06 273/DIG. 4
4,003,576 A * 1/1977 Carella ..... F42B 6/06 244/3.23
4,392,654 A * 7/1983 Carella ..... F41B 5/1446 264/145
4,477,084 A * 10/1984 Austin ..... F42B 6/06 244/3.24
4,502,692 A * 3/1985 Humphrey ..... F42B 6/06 473/586
4,615,552 A * 10/1986 Bengtson ..... F42B 6/06 244/3.24
5,024,448 A * 6/1991 Barrie ..... F42B 6/06 473/586
5,039,110 A * 8/1991 Honda ..... F42B 6/06 473/586

(Continued)

OTHER PUBLICATIONS

"Arrow Fletching and F.O.C. Balance" [online], Jon Henry, [Published on Mar. 20, 2011], retrieved from the Internet: <https://www.longrangehunting.com/articles/arrow-fletching-and-f-o-c-balance.482/>.

(Continued)

*Primary Examiner* — Alexander R Niconovich
(74) *Attorney, Agent, or Firm* — Warner Norcross + Judd, LLP

(57) ABSTRACT

A vane, for a projectile such as an archery arrow, including a ribbon strip having a leading ribbon edge that is twisted to induce spin of the projectile during its flight. The vane can include a base that mounts to a projectile surface. The ribbon strip can extend upward from the base and can be semi-rigid but flexible. The ribbon strip can include an intermediate portion spaced a distance from and free from attachment to the projectile surface so as to form a gap under the intermediate portion. The ribbon strip can include a second ribbon end that is attached to the base rearward of the first end. It also can include a fin that extends upward from the base within a gap between the ribbon strip and base. The ribbon strip alternatively can include a cantilevered second ribbon end that is free from attachment to the base and projectile.

20 Claims, 24 Drawing Sheets

(56) References Cited

U.S. PATENT DOCUMENTS

| | | | | |
|---|---|---|---|---|
| 5,443,273 | A | 8/1995 | Lovorn | |
| 5,613,688 | A * | 3/1997 | Carella | F42B 6/06 473/586 |
| 6,142,896 | A * | 11/2000 | Simo | F42B 6/06 473/586 |
| D449,090 | S | 10/2001 | DelMonte | |
| D465,541 | S | 11/2002 | Surrusco | |
| 6,695,727 | B1 * | 2/2004 | Kuhn | F42B 6/06 473/586 |
| 7,074,143 | B2 | 7/2006 | Czemske et al. | |
| D599,874 | S | 9/2009 | Klein | |
| D606,615 | S | 12/2009 | Andrews | |
| D612,444 | S | 3/2010 | Klein | |
| 7,914,406 | B2 * | 3/2011 | Andrews | F42B 6/06 473/578 |
| 8,025,596 | B2 * | 9/2011 | Klein | F42B 10/08 473/586 |
| 8,038,552 | B2 * | 10/2011 | Song | F42B 6/06 473/586 |
| 8,105,189 | B1 * | 1/2012 | Huang | F42B 6/06 473/586 |
| 8,286,953 | B2 | 10/2012 | Barnes et al. | |
| 8,388,474 | B1 * | 3/2013 | Griffith | F42B 6/06 473/586 |
| 8,485,923 | B2 | 7/2013 | Kozlik et al. | |
| 8,523,718 | B1 * | 9/2013 | Kuhn | F42B 6/06 473/586 |
| 8,602,926 | B2 | 12/2013 | Griffith et al. | |
| D716,901 | S | 11/2014 | Billsby et al. | |
| 8,920,270 | B2 * | 12/2014 | DeLap | F42B 6/06 473/586 |
| 9,039,550 | B1 | 5/2015 | Broberg | |
| 9,250,047 | B2 | 2/2016 | Song | |
| D788,249 | S | 5/2017 | Kim | |
| D788,250 | S | 5/2017 | Kim | |
| D833,559 | S | 11/2018 | Kim | |
| 2005/0159256 | A1 * | 7/2005 | Simo | F42B 6/06 473/586 |
| 2007/0173359 | A1 | 7/2007 | Mowery et al. | |
| 2009/0186723 | A1 | 7/2009 | Andrews | |
| 2013/0274041 | A1 * | 10/2013 | Griffith | F42B 6/06 473/586 |
| 2014/0004983 | A1 | 1/2014 | DeLap et al. | |
| 2016/0377393 | A1 | 12/2016 | Potter | |

OTHER PUBLICATIONS

"Fletching With Feathers vs Vanes" [online], advancecompoundbow.com [Published on Sep. 25, 2017], retrieved from the Internet: <http://advancecompoundbow.com/fletching-with-feathers-vs-vanes/>.

* cited by examiner

ARCHERY ARROW VANE

BACKGROUND OF THE INVENTION

The present invention relates to archery products, and more particularly to a vane on an archery arrow to stabilize the arrow in flight.

Archery arrows typically are outfitted with feathered or polymeric sheet type vanes to stabilize the arrows in flight. Vanes produce lift and lateral force on the arrow which in turn stabilizes the arrow's flight pattern by moving the center of pressure rearward. In turn, this usually provides consistent arrow flight and can improve shot accuracy.

Lift and lateral forces can be increased by increasing the surface area of a vane, however, there is a limit to the overall vane size for improving stabilization. For example, while theoretically stabilizing arrow flight, larger vanes can interfere with an arrow rest as the arrow is shot from a bow. This interference can negate any improved stabilization due to the increased surface area of the larger vane. This can be particularly problematic for slower moving arrows propelled by lower energy bows, such as recurves and long bows.

Accordingly, archers and manufacturers turn to other features of vanes to improve arrow flight and stablization. For example, some offset the arrow vanes fore to aft to induce spin on the arrow via the vanes. Others utilize vanes having an upright, generally planar blade with a slight fore to aft curvature. While these types of vanes do produce spin, sometimes they do not produce enough spin to provide notable stabilization, particularly, for slower moving arrows, such as those shot from bows like recurves and long bows.

Further, offset and pre-curled vanes many times are stressed, bent, deformed or kinked as they are manipulated and mounted on a cylindrical arrow shaft. As a result, such vanes can become slightly misshapen. This can produce aerodynamic defects or unwanted anomalies in the vanes, or can make the vanes prone to damage in flight or upon impact with a target. After time, this can also reduce the amount of arrow stabilization intended by the use of such vanes.

Accordingly, there remains room for improvement in the field of archery arrow vanes, and in particular, ones that can impart stabilization forces on the arrow and improve the flight of the arrow.

SUMMARY OF THE INVENTION

A vane, for a projectile, is provided where the vane includes a ribbon strip having a leading ribbon edge that is twisted to induce spin of the projectile during its flight.

In one embodiment, the vane can include a base that mounts to a projectile surface. The ribbon strip can extend upward from the base. The ribbon strip and the base can be constructed from a semi-rigid but flexible material. The flexible material can enable the vane to clear an archery component, such as an arrow rest, when a projectile, such as an arrow; to which the vane is attached is shot.

In another embodiment, the ribbon strip can include an intermediate ribbon portion spaced a distance from and free from attachment to the projectile surface and from the underlying base so as to form a gap under the intermediate ribbon portion. In some cases, the intermediate ribbon portion can be spaced a distance from the base and particular, an intermediate base portion, for optionally greater than one third the length of the base, further optionally greater than one half the length of the base, and further optionally greater than two thirds the length of the base or other lengths depending on the application.

In still another embodiment, the ribbon strip can include a second ribbon end that is attached to the base rearward of the first end. Thus, the first ribbon end and the second ribbon end can be attached to a corresponding first base end and a corresponding second base end, with an intermediate ribbon portion therebetween being disassociated and physically separated from the base between those base ends. That intermediate ribbon portion can be free-floating and distal from the base in that region.

In yet another embodiment, the ribbon strip can be a generally flat, planar strip of material that is twisted between its ends so that the ribbon takes on a twisted and/or partially helical configuration between the ends. In some cases, the side edges of the ribbon strip also twist and therefore are spaced different distances from the base along different segments of the ribbon strip.

In a further embodiment, the vane can include a fin that extends upward from the base within a gap between the ribbon strip and base. The fin can be planar and/or in some cases, furled or offset from a longitudinal axis of the base to further impart spin to the projectile. The fin can be generally perpendicular to some portions of the ribbon, and generally parallel to other portions of the ribbon, for example, the first and second ribbon ends.

In still a further embodiment, the ribbon strip can include a cantilevered second ribbon end that is free from attachment to the base and projectile. Thus, the first ribbon and can be joined with the base, while the intermediate ribbon portion and the second free end can be free or otherwise cantilevered above the base and/or rearward of the base, optionally over a projectile surface when the vane is mounted to the projectile.

The vane of the current embodiments is well-suited to induce spin to an associated projectile, such as an arrow, during flight. With the twisted ribbon strip and leading ribbon edge, spin to the projectile can be easily and consistently induced, particularly for slow-moving projectiles such as arrows shot from low speed archery bows. Where the vane material is semi-rigid but flexible, the vane can retain its shape during arrow acceleration and flight, but can also withstand impact with a portion of a an archery bow riser or arrow rest without permanently deforming the vane. Accordingly the vane can be used multiple times, for the life of the arrow in some cases. Where the vane includes a fin under the ribbon strip, the fin can aid in arrow flight correction and/or stability of the arrow during flight. The ribbon strip also can provide a leading ribbon edge that has a significant surface area useful for creating aerodynamic stability and a center of pressure similar to higher profile vanes, including standard pre-curled vanes.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A vane for use with a projectile in accordance with a current embodiment is illustrated in FIGS. 1-7 and generally designated 10. The vane 10 can be joined with a projectile 100, along with a number of other similar names 10' and 10". The vane 10 can be attached to the projectile using adhesives, fasteners or other devices. As shown, three similar vanes are disposed radially around an outer surface 101 of the projectile 100. These similar vanes can be disposed at regular intervals around the outer surface 101, for example, they can be spaced at 120° apart as shown, of course, other spacing intervals can be used as well. The outer surface 101 can be substantially cylindrical as shown, or can take on other geometric shapes. The projectile 100 can be an arrow, however, as used herein projectile can refer to any type of arrow, bolt, spear, or other elongated device intended to be shot, launched or thrown. Further, as used herein, an archery arrow can include an arrow or a bolt for use with bows, such as recurve bows, long bows, compound bows, cross bows and the like.

Figure 1:
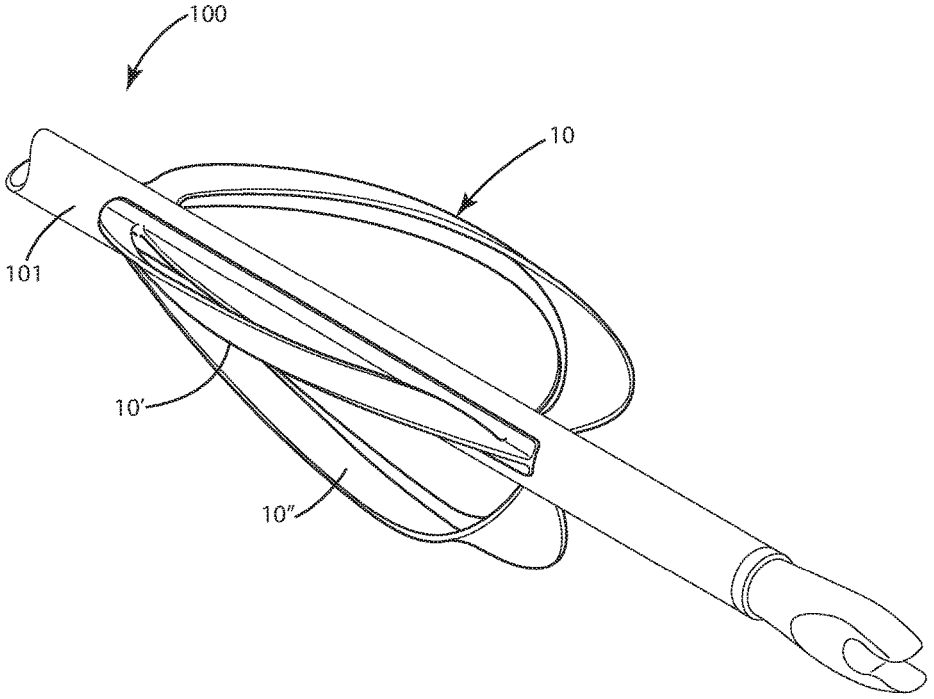
FIG. 1 is a rear perspective view of an archery vane of a current embodiment on an arrow.
Figure 2:
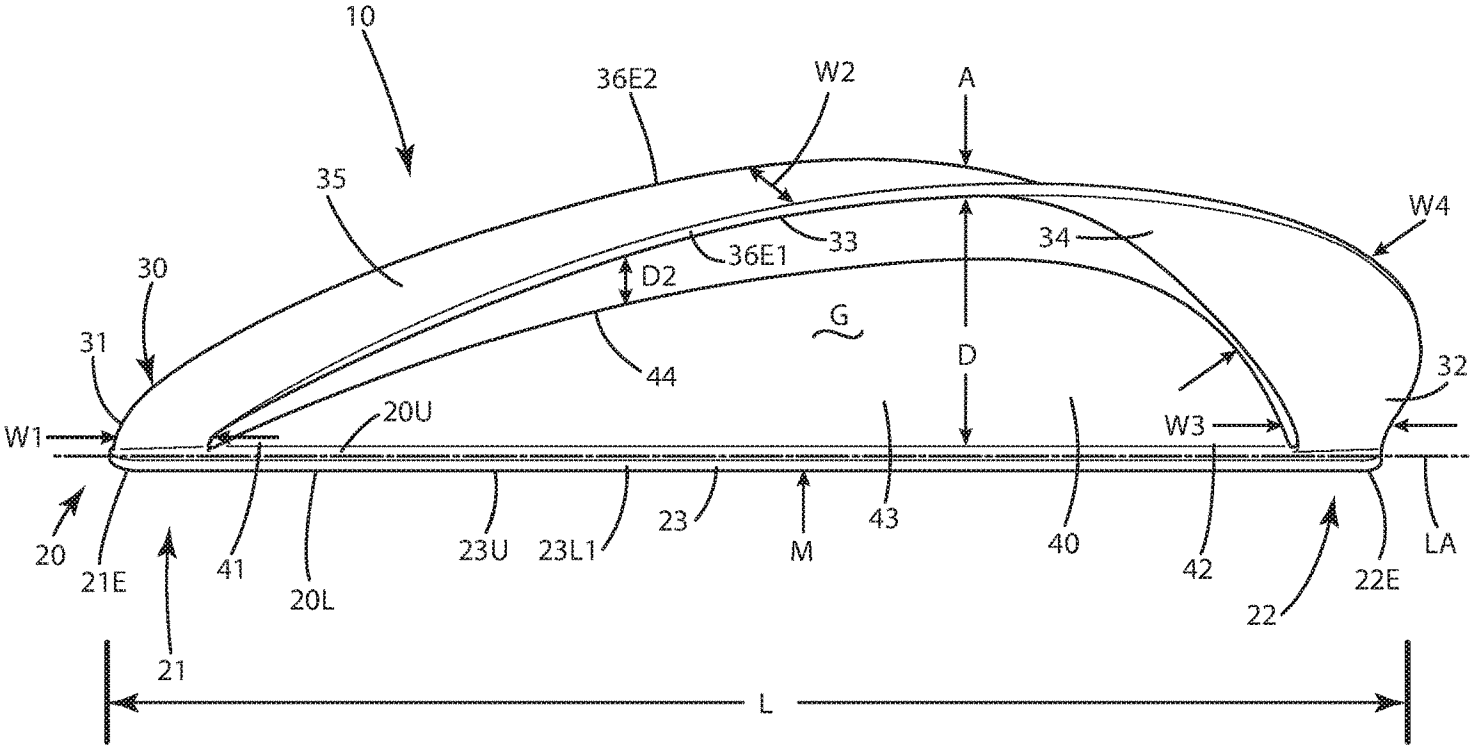
FIG. 2 is a right side view thereof.
Figure 3:
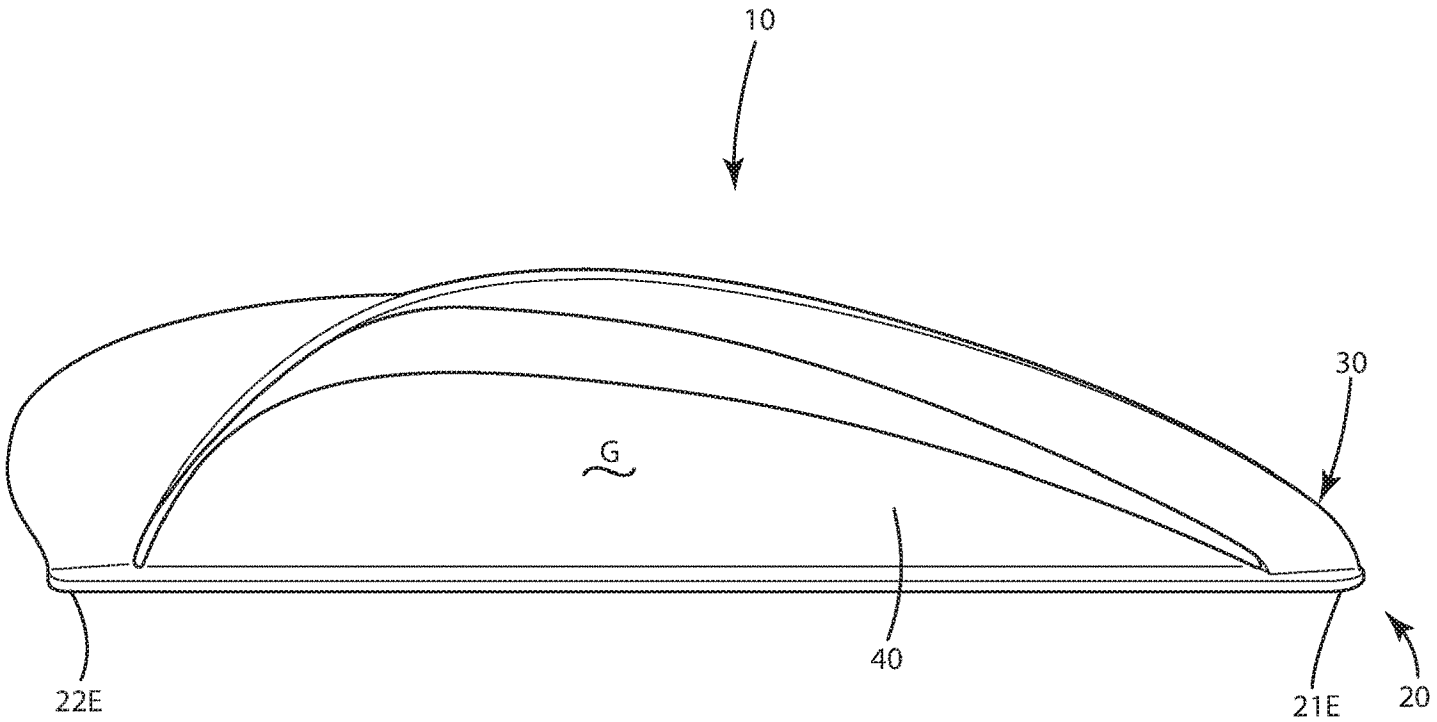
FIG. 3 is a left side view thereof.

As shown in FIG. 2, the vane 10 can include a base 20 and a ribbon strip 30. The base 20 can be a generally elongate and somewhat flat member that is integrally formed with the ribbon strip 30. The base 20 can include a first base end 21 and a second distal base end 22. The first base end 21 can include a first base end edge 21E and a second base end edge 22E. With reference to the front view in FIG. 4, and the rear view in FIG. 5, the first base end 21 and the second base end 22 can be of a similar contour on the lower surface 20L of the base 20. Optionally, the entire base 20 can include a concave contour 20C that extends the first end 21 to the second end 22. This concave contour 20C can be generally rounded and/or partially cylindrical so as to match the surface 101 of the projectile 100 which is in the form of an arrow.

With reference to FIG. 2, the base 20 also can include an intermediate base portion 23 that extends between the first base end 21 and the second base end 22. The intermediate base portion 23 can be elongate and can include the contour 20C on its lower surface 20L. The intermediate base portion 23, as well as the base in general, can include a longitudinal axis LA that extends along the length L of the base and the intermediate base portion 23. The base 20 as shown can include a first lateral side 23L1 and a second lateral side 23L2 that are disposed on opposing lateral sides of the longitudinal axis LA. The first and second lateral sides can terminate at corresponding lateral side base edges 23E1 and 23E2 on opposite sides of the longitudinal axis LA of the base. These lateral edges can be equidistant from and generally parallel to one another along the length L of the vane 10. Of course, in some applications, the distance between the lateral edges can vary.

The base 20 also can include an upper base surface 20U and a lower base surface 20L disposed on respective upper and lower portions of the base 20. These upper and lower surfaces can run the length L of the base, from the first and through the intermediate base portion into the second end. These upper and lower surfaces can be contoured, for example rounded and/or concave or convex as shown in figs four and five.

Optionally, although shown in the form of an elongated base, the base also can take on other forms. For example, in some cases it may be suitable to construct the base in the form of a sleeve or tube that can fit around the projectile 100 or a portion thereof. In such a construction, multiple vanes can be integrally formed with a sleeve or tube at regular intervals, extending radially outward from the base, sleeve or tube. The vanes can be secured to the projectile by shrinking, adhering or otherwise friction fitting the tube on the projectile.

Returning to FIGS. 2-4, the vane can include a ribbon strip or ribbon 30. The ribbon strip 30 can extend upward from the base 20. The ribbon strip 30 can include a first ribbon end 31 and a second ribbon end 32. The ribbon strip can include an intermediate ribbon surface 33 between the first end 31 and the second end 32. Generally, between the first end 31 and the second end 32, the ribbon strip 30 can be twisted such that it takes on a twisted shape. One example of a twisted shape is a helical configuration, but of course other twisted shapes can be embodied in the ribbon strip between the first and second ends. Further, the shape need not be a perfect helical shape to be considered twisted or at least partially helical. The twisted shape of the ribbon strip also can be permanently and/or integrally formed therein. For example, the material from which the ribbon is constructed can be molded and/or set permanently and/or integrally in the twisted shape. In such a construction, even if both ends, 31, 32 are free, the ribbon would retain the twisted shape and not unravel substantially.

The ribbon strip 30 can include a leading ribbon surface 35 and a lower or trailing ribbon surface 34. Optionally, for up to half and/or a majority of the length L of the base and/or vane, the leading ribbon surface can face generally outward and away from the upper surface 20U of the base 23. Of course, as described below, this leading ribbon surface 35 can face other relative directions to the respective first 23L1 and second 23L2 lateral sides.

As shown, the intermediate portion 33 can extend rearward from the first ribbon end 31 toward the second ribbon end 32. The intermediate ribbon portion 33 can be spaced a distance D from parts of the base, such as the intermediate base portion 23 and its upper surface 20U or lower surface 20L. This distance D can be variable, changing from the first ribbon end 31 to the second ribbon end 32. At the first end 31, the ribbon strip 30 can be attached directly to the first base end 21. At the second end 32, the ribbon strip 30 can be attached directly to the second base end 22. In these locations of attachment, the ribbon strip 30 can be integrally formed, glued, adhered, welded, or otherwise fastened or attached to the base, and in particular the respective base ends.

In regions where there is a gap G or other space between the ribbon strip and base, for example, where the ribbon strip is spaced the distance D from and free from attachment to the base, as well as the surface of the projectile, the ribbon strip can include a twisted shape as mentioned above. With such a feature, the leading ribbon surface 35 can be twisted rearward of the first ribbon end 31 as it extends toward the second ribbon end 32. The lower ribbon surface or trailing ribbon surface 34 also can be spaced the distance D above the base 20 in the intermediate ribbon portion 33. Again this distance D can be variable depending on the location of the measurement of the distance D. As shown, for example in FIG. 2, the distance D can become greater as the ribbon strip 30 extends rearward from the first end 31 toward the second end 32. In some cases, the distance D can be greatest at an apex A of the ribbon strip 30, where at least a portion of the ribbon strip is at a maximum distance away from the upper surface 20U of the base 20. In some cases, that apex A can be located rearward of the middle M of the base, closer to the rear end or second end 22 of the base 20. Optionally, the greatest distance D between the lower ribbon surface 34 and the ribbon strip can be between the middle M and the second or rear end 22, and further optionally located closer to the middle M than to the rear end. In other cases, the apex A can be located halfway between the middle M and the second end 22, or other locations depending on the configuration of the vane.

Figure 4:
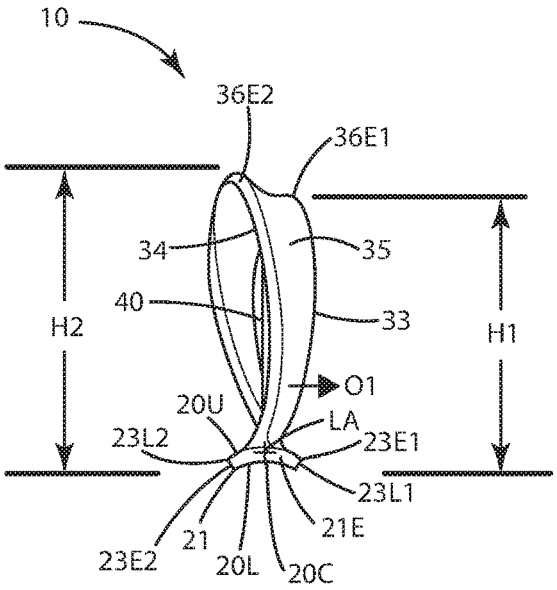
FIG. 4 is front view thereof.
Figure 5:
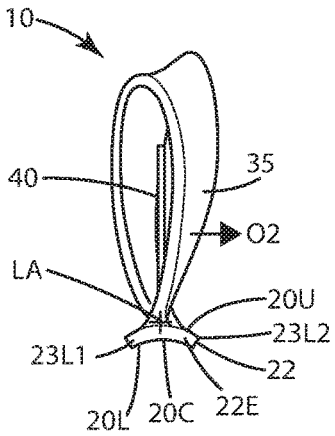
FIG. 5 is rear view thereof.

The ribbon strip as mentioned above can include a lower ribbon surface 34. The lower ribbon surface 34 can face downward, generally toward the surface of the projectile 101 or generally downward toward the base and/or upper surface 22 of the base. The lower ribbon surface 34 and the upper or leading ribbon surface 35 can be contoured oppositely from one another or similar to one another. For example, as shown in FIG. 4, the leading ribbon surface 35 can be concave in the intermediate portion 33. In this intermediate portion 33, the leading ribbon surface 35 also can face outward, away from the base. The lower ribbon surface 34 can face downward, toward the base. The lower ribbon surface 34 also can be concave upward, mimicking the contour of the leading ribbon surface so that the concave contours are somewhat parallel.

Optionally, the leading ribbon surface 35 and the lower ribbon surface 34 can extend on the first and second lateral sides 23L1, 23L2 of the longitudinal axis LA in different regions. For example, in the intermediate portion 33, the leading ribbon surface 35 and the lower ribbon surface 34 can extend from a first ribbon side edge 36E1 to a second ribbon side edge 36E2. These side edges can extend downward with the ribbon strip to the base. As shown in FIG. 4, the first ribbon side edge 36E1 can be spaced a first height H1 above the lower base surface 20L. The second ribbon edge 36E2 can be spaced a second height H2 above the lower base surface 20L. The second height H2 can be greater than the first height H1, depending on the twist of the ribbon. In some cases, the height H2 can be expressed in a ratio to the height H1. That H2:H1 ratio can be optionally at least 1.01:1, further optionally, at least 1.1:1, yet further optionally at least 1.2:1, even further optionally at least 1.3:1, yet further optionally 1.4:1, even further optionally 1.5:1, yet further optionally at least 1.6:1, still further optionally between 1.01:1 and 7:1, inclusive, or other ratios depending on the rate of twist.

Near to the ends, the respective first ribbon side edge 36E1 and second ribbon side edge 36E2 can extend the same height from the base. For example, at the first end 31, the first ribbon side edge 36E1 can be at the same elevation or height, as the second side edge 36E2. Thus, both edges can be at equal distances from the base. The opposite ribbon end 32 can be similarly configured. Optionally, the first side edge 36E1 can be rearward of the second side edge 36E2 at the first ribbon end 31. Likewise, at the second ribbon end 32, the first ribbon side edge 36E1 can be rearward of the second ribbon side edge 36E2. Of course, in some applications with extreme twists of the ribbon strip, at the second end 32, the first ribbon side edge 36E1 can be rearward of the second ribbon side edge 36E2.

Figure 6:
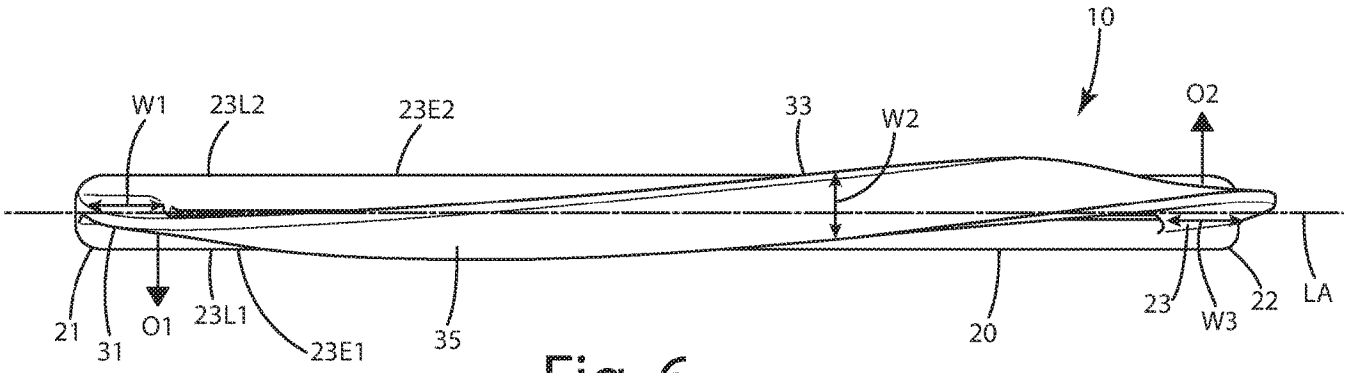
FIG. 6 is a top view thereof.
Figure 7:
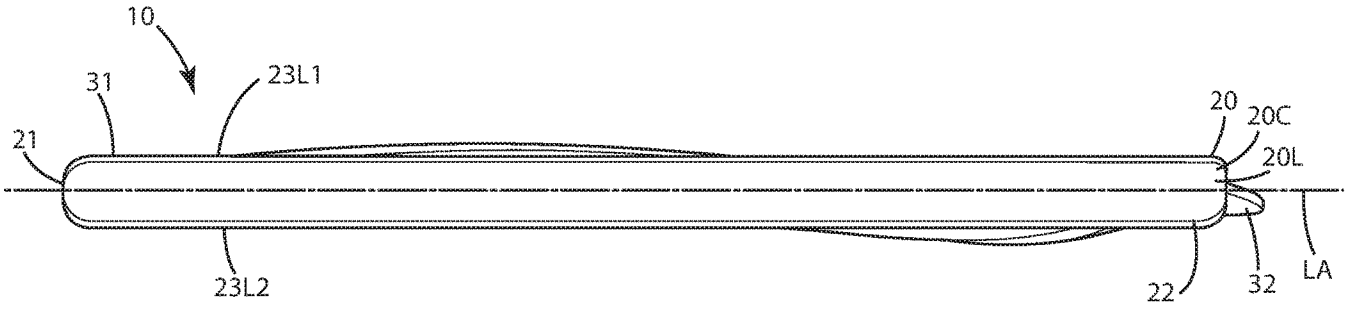
FIG. 7 is a bottom view thereof.
Figure 8:
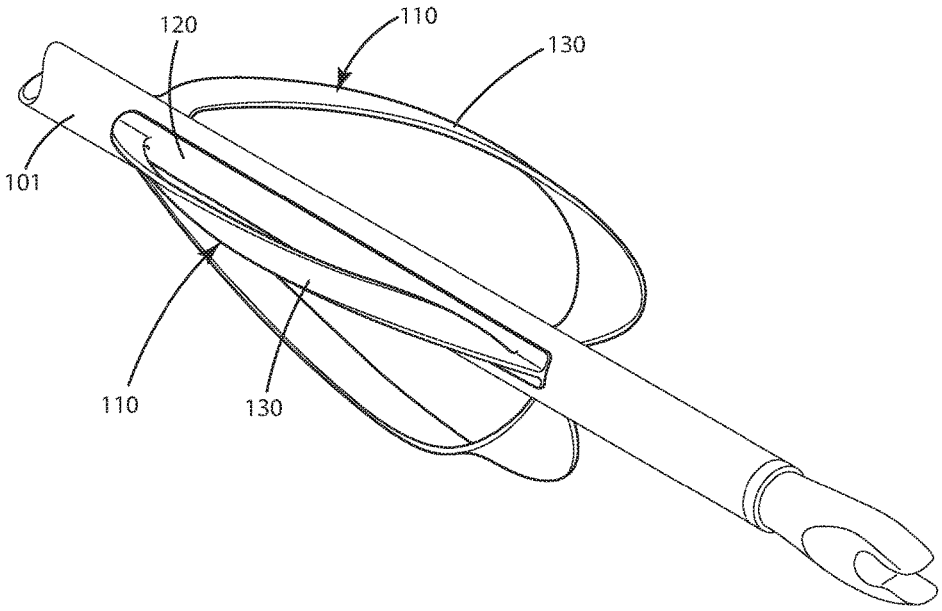
FIG. 8 is a rear perspective view of an archery vane of a first alternative embodiment on an arrow.
Figure 9:
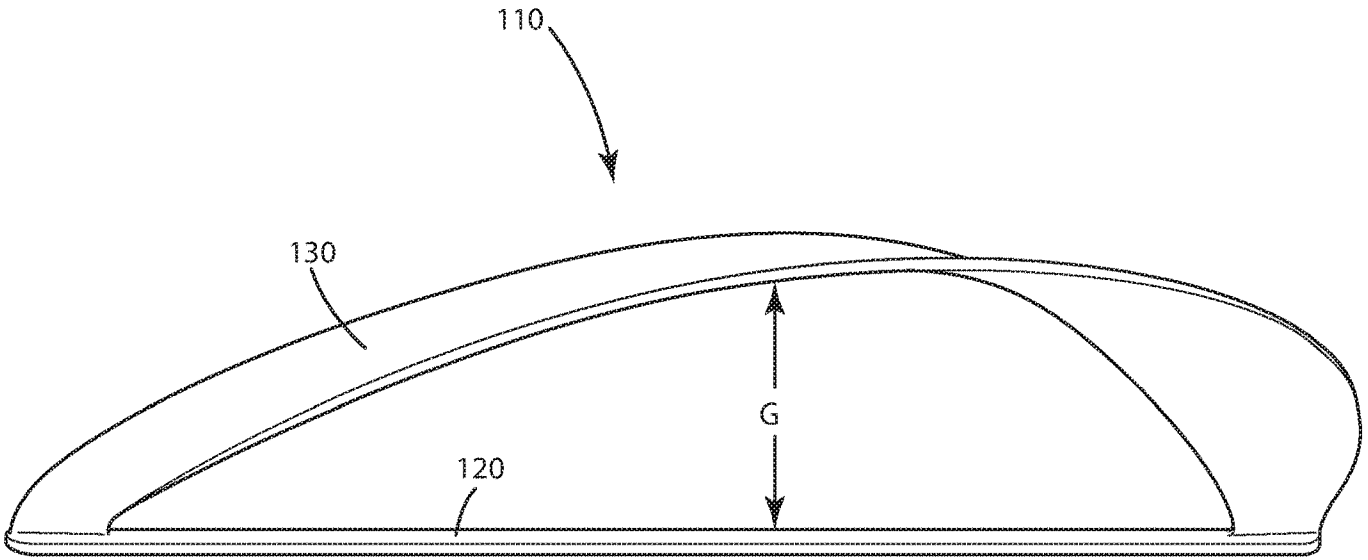
FIG. 9 is a right side view thereof.
Figure 10:
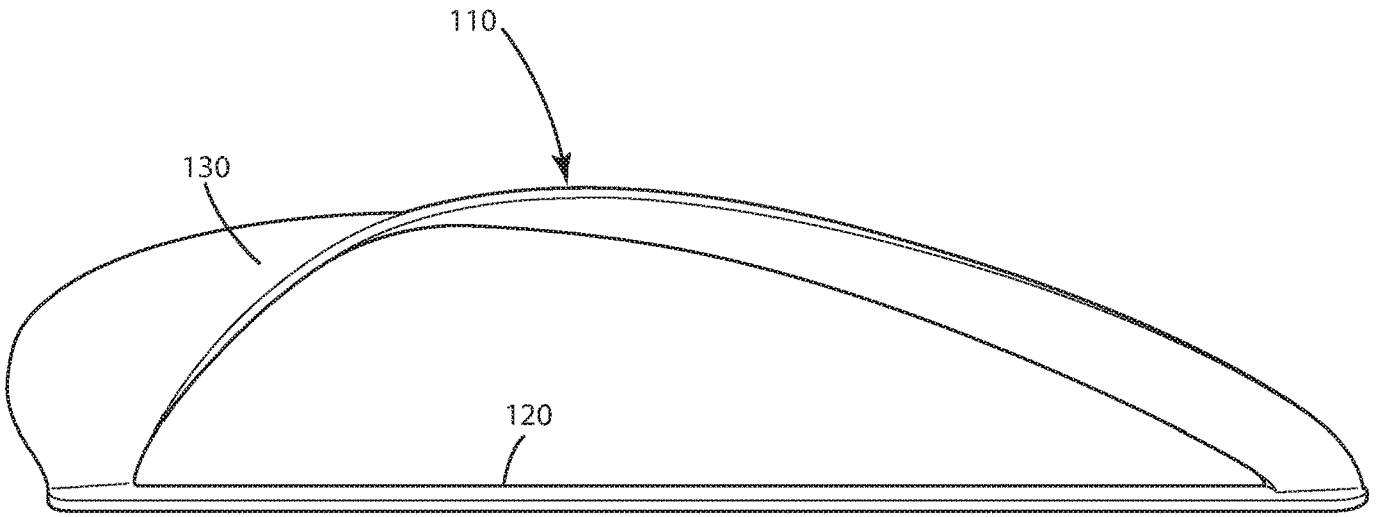
FIG. 10 is a left side view thereof.
Figure 11:
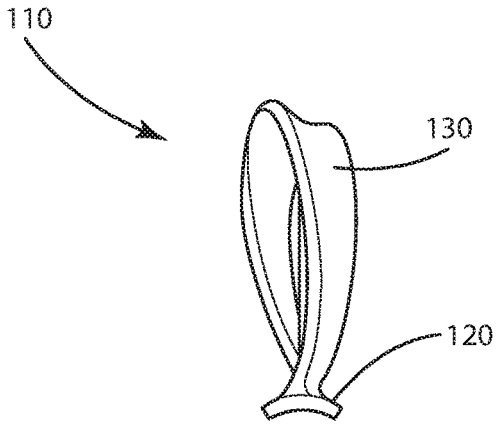
FIG. 11 is front view thereof.
Figure 12:
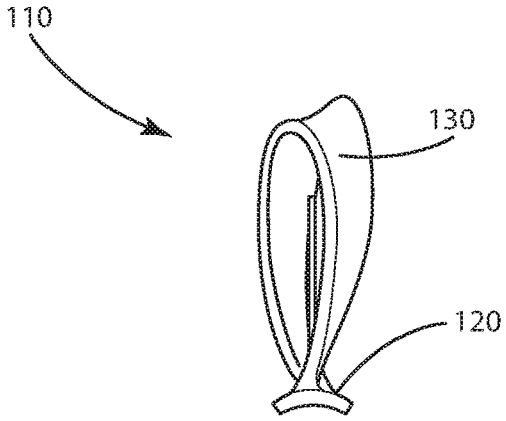
FIG. 12 is rear view thereof.
Figure 13:
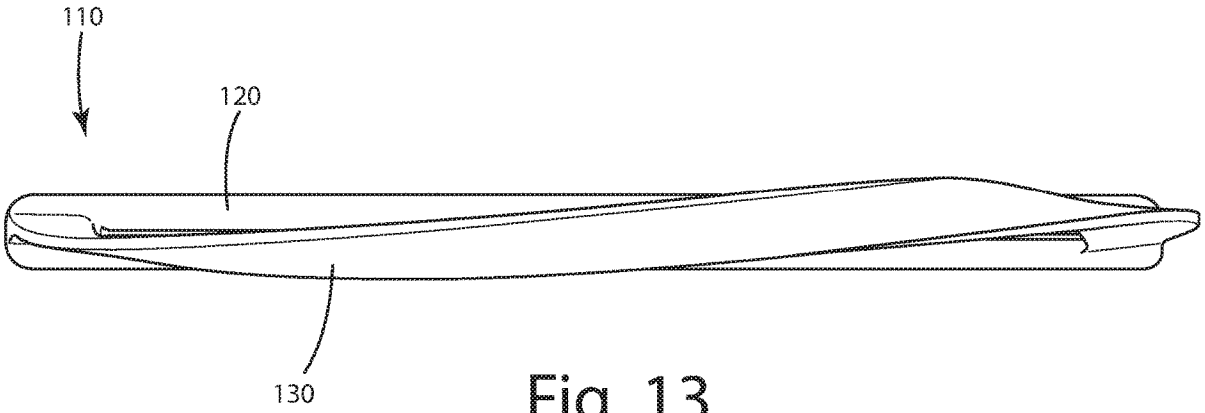
FIG. 13 is a top view thereof.
Figure 14:
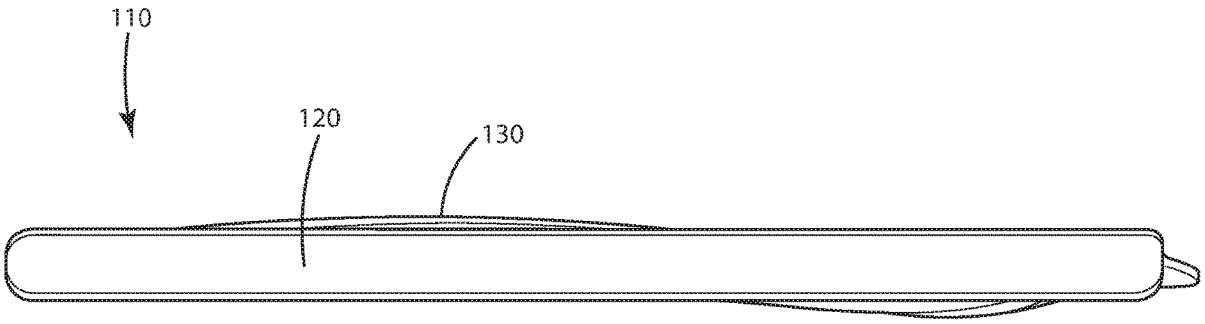
FIG. 14 is a bottom view thereof.
Figure 15:
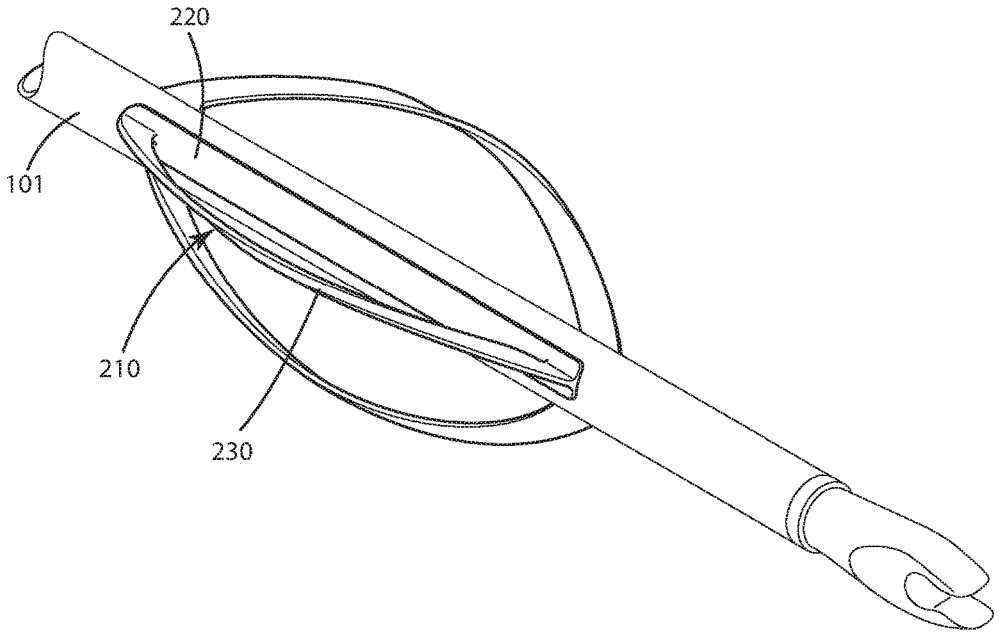
FIG. 15 is a rear perspective view of an archery vane of a second alternative embodiment on an arrow.
Figure 16:
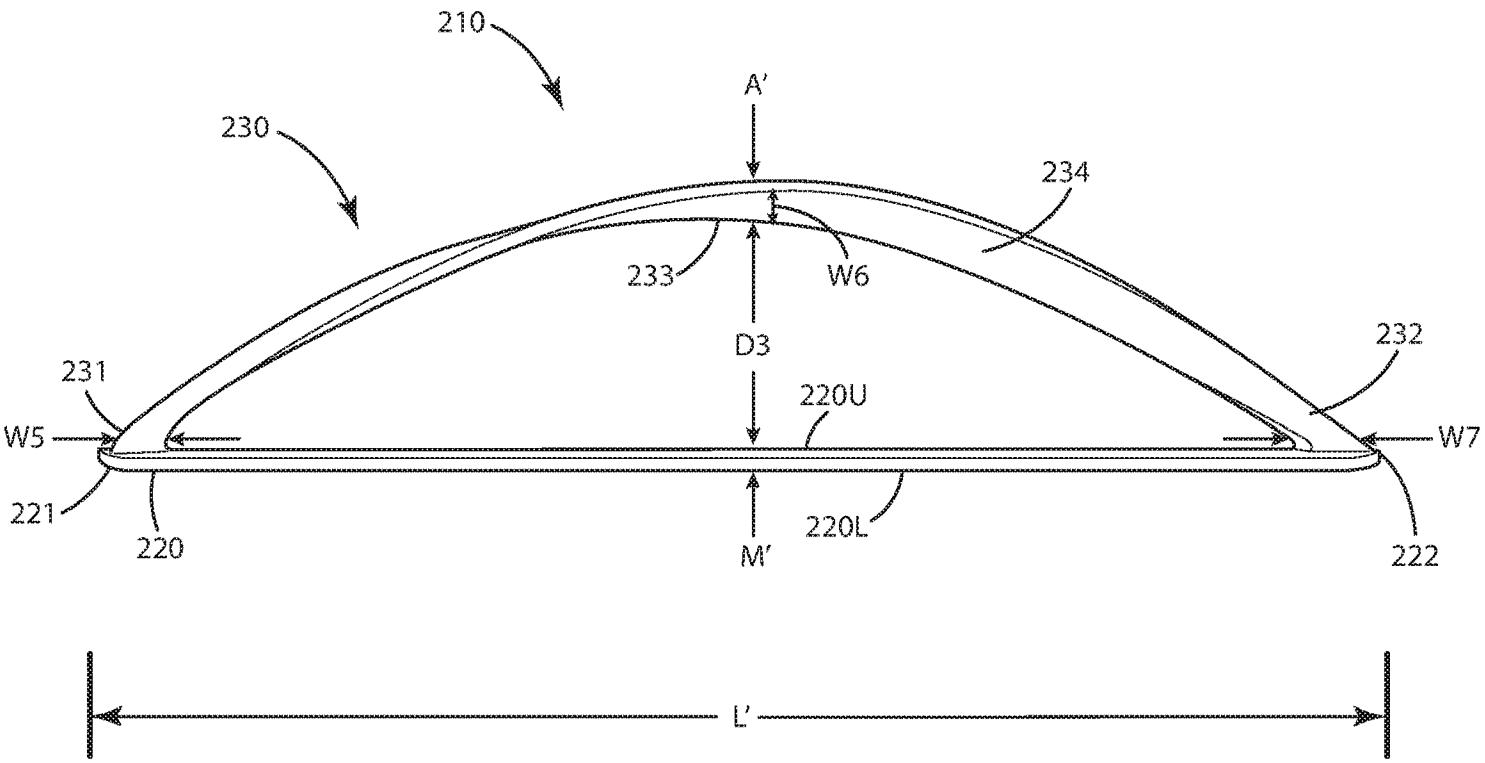
FIG. 16 is a right side view thereof.
Figure 17:
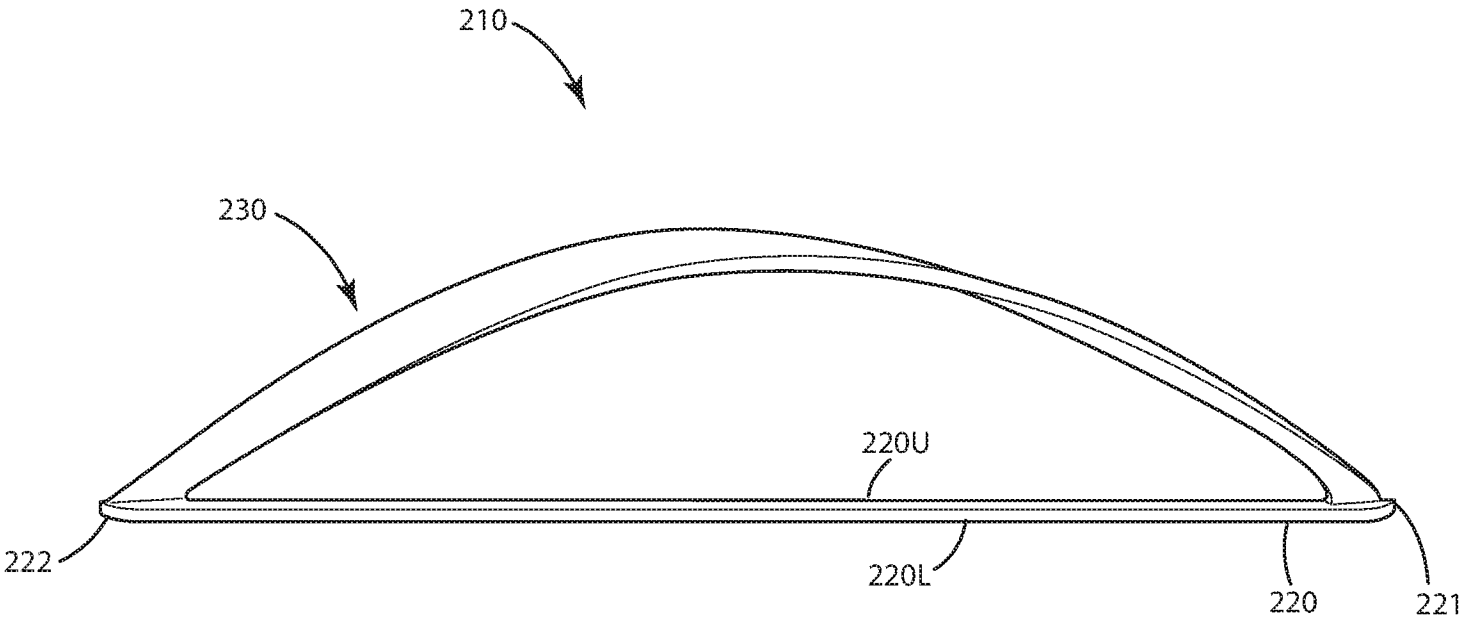
FIG. 17 is a left side view thereof.
Figure 18:
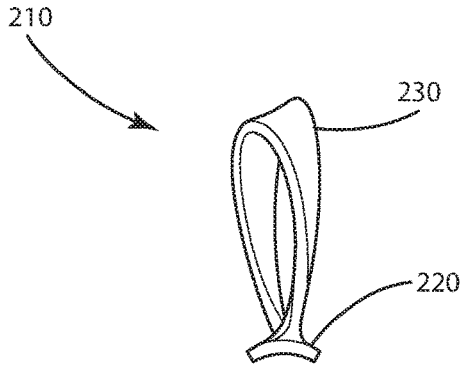
FIG. 18 is front view thereof.
Figure 19:
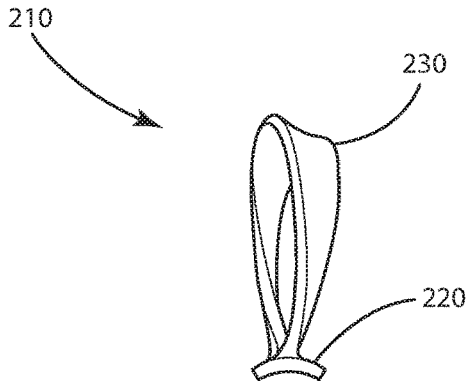
FIG. 19 is rear view thereof.
Figure 20:
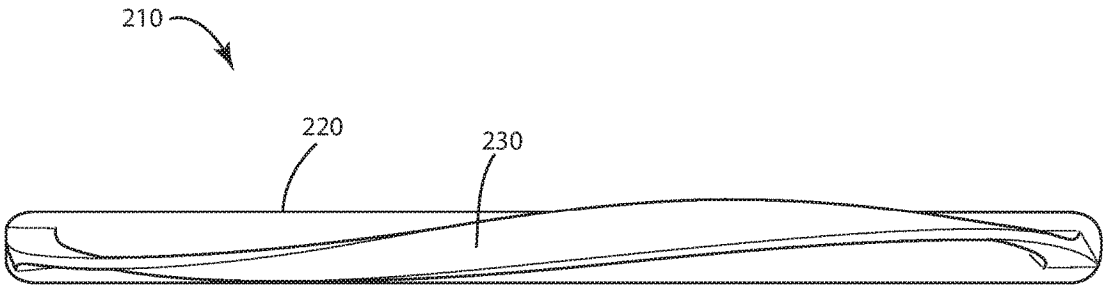
FIG. 20 is a top view thereof.
Figure 21:
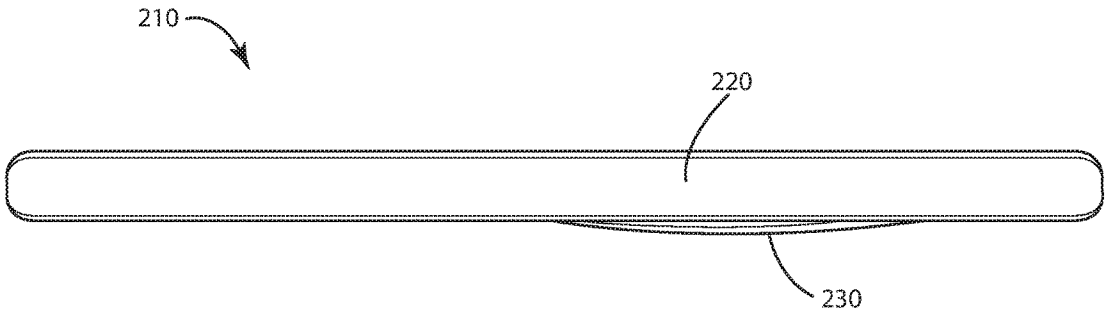
FIG. 21 is a bottom view thereof.
Figure 22:
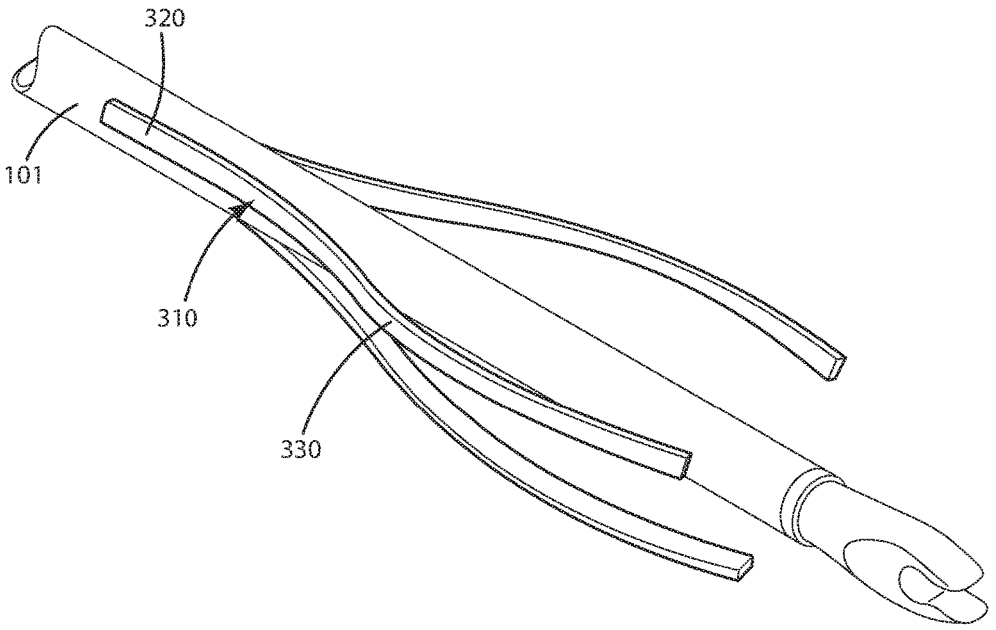
FIG. 22 is a rear perspective view of an archery vane of a third alternative embodiment on an arrow.
Figure 23:
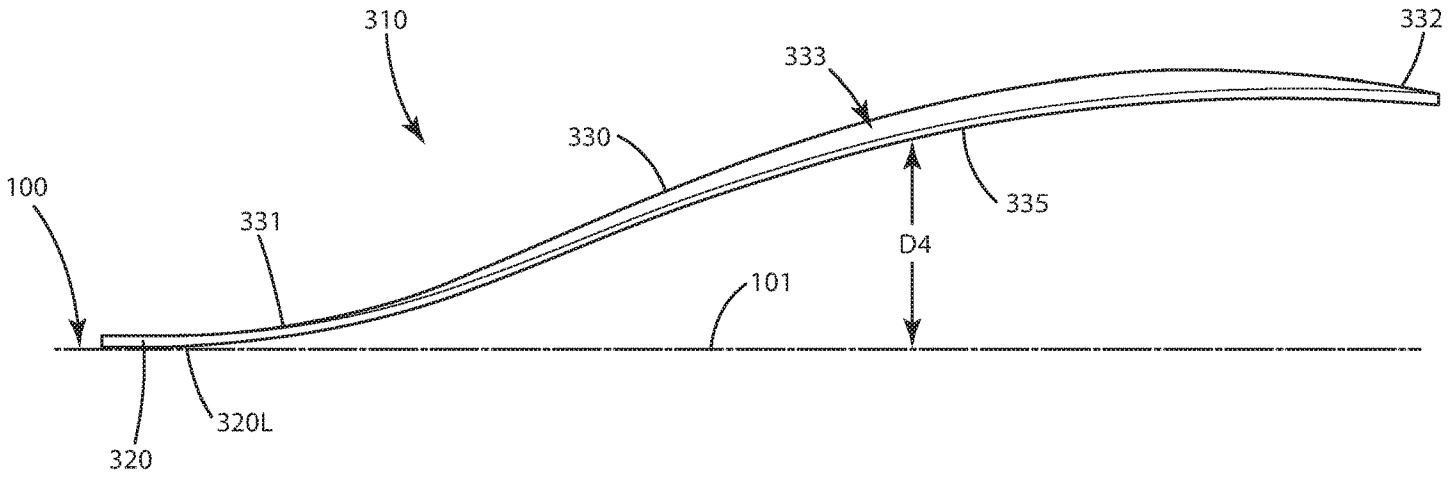
FIG. 23 is a right side view thereof.
Figure 25:
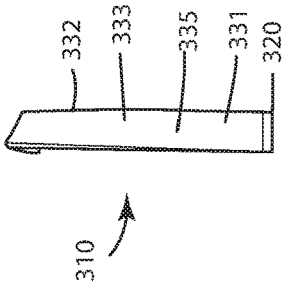
FIG. 25 is front view thereof.
Figure 26:
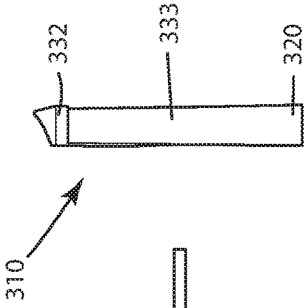
FIG. 26 is rear view thereof.
Figure 24:
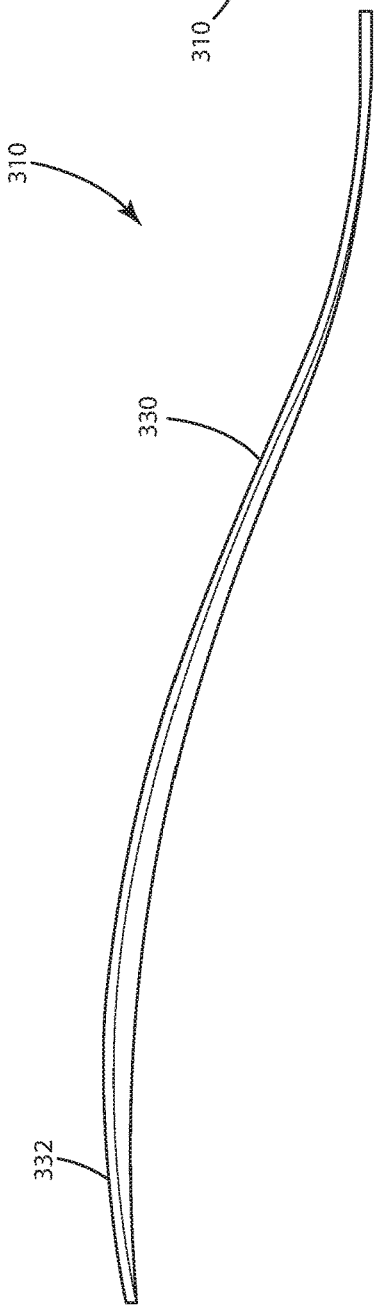
FIG. 24 is a left side view thereof.
Figure 27:
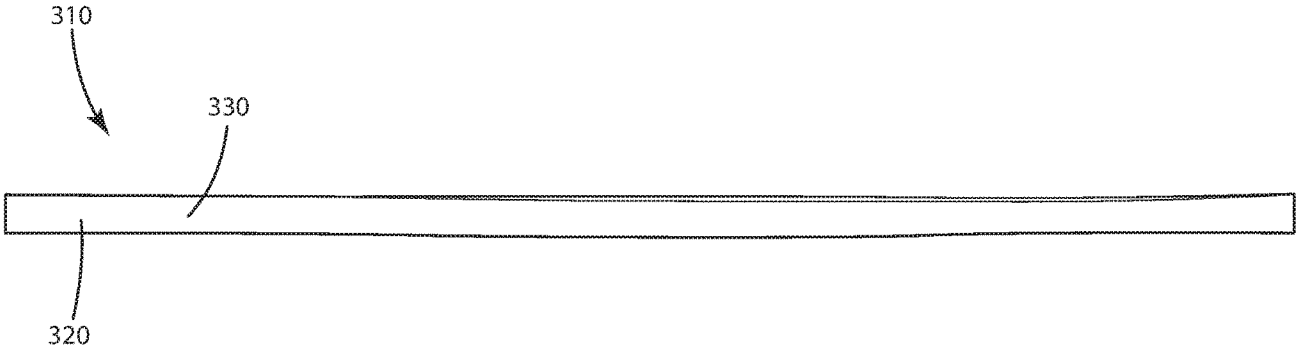
FIG. 27 is a top view thereof.
Figure 28:
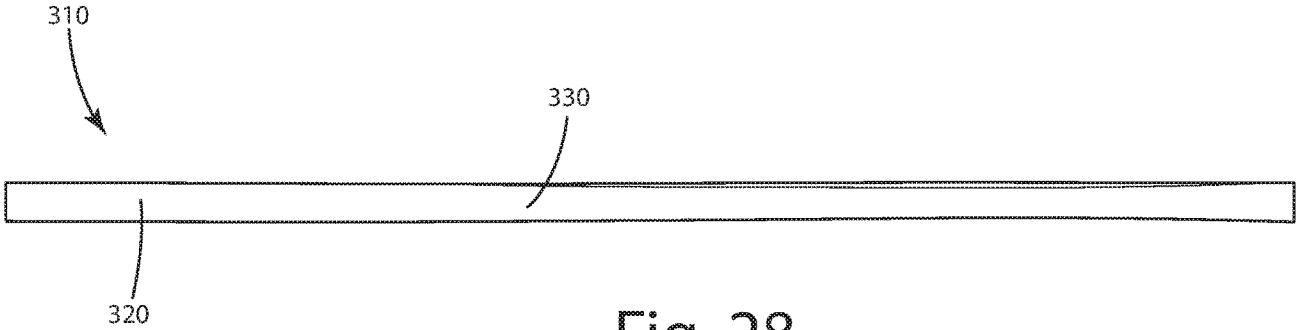
FIG. 28 is a bottom view thereof.
Figure 29:
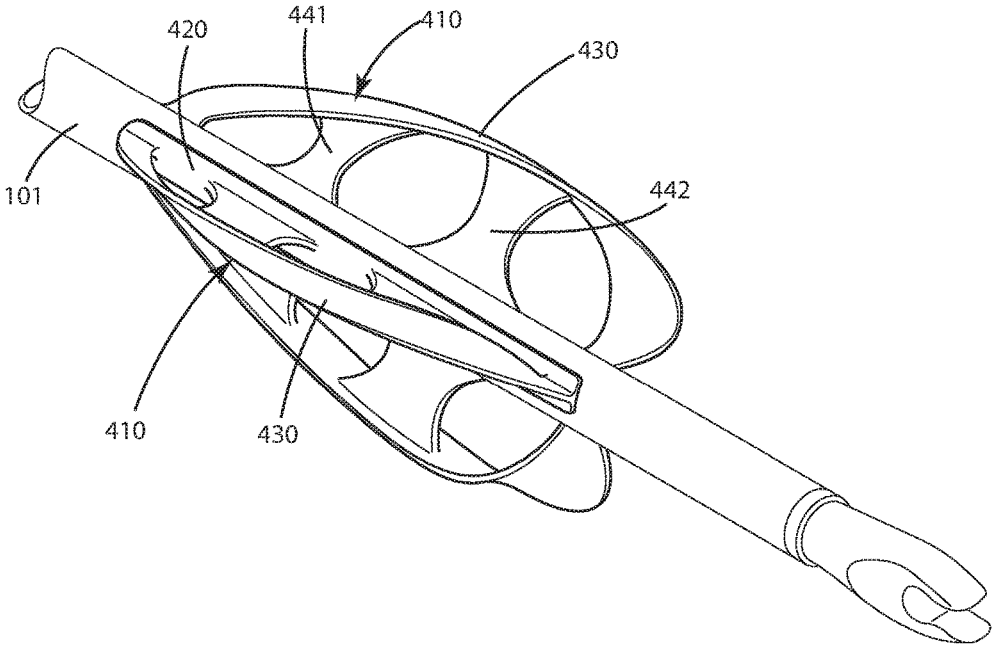
FIG. 29 is a rear perspective view of an archery vane of a fourth alternative embodiment on an arrow.

As shown in FIGS. 2, 4 and 6, the ribbon strip 30 can include several widths. For example, at the first end 31, the ribbon strip 30 can include a first width W1. In the intermediate portion 33, the ribbon strip 30 can include a second width W2, while at the second end 32, the ribbon strip 30 can include a third width W3. Optionally, all of these widths can be substantially equal in dimension, however, their orientations relative to the longitudinal axis LA of the base and vane in general can differ. For example, the width W1 can be substantially parallel to the longitudinal axis LA. By substantially parallel, it is meant that the first ribbon end 31 and/or its width W2 can be offset at an angle between 0° and 7° inclusive from parallel with the longitudinal axis. The width W2 in the intermediate ribbon portion, can generally lay along a linear dimension taken perpendicular to the first and second ribbon side edges 36E1 and 36E2. The width W2 can be transverse to the longitudinal axis LA. In some cases, for example near the apex A or other places in the intermediate ribbon portion, the width W2 optionally can be perpendicular to the longitudinal axis LA.

Further optionally, in some constructions, the width of the ribbon rearward of the apex A and generally closer to the second ribbon end 22 can be greater than the other widths of the ribbon. For example, the width W4 of the ribbon shown in FIG. 2 can be greater than the ribbon width W2 as well, as the width W3 and W1 of the ribbon elsewhere along the ribbon 30. In some cases, the width W4 can be in a ratio relative to any of the other widths W1, W2, W3. That ratio of W4:W1, W2 or W4 can be optionally at least 1.2:1, further optionally at least 1.5:1, still further optionally at least 2:1, or other ratios depending on the profile of the ribbon strip.

With reference to FIGS. 4 and 6, the various surfaces of the ribbon strip 30 can face in different directions throughout the length L of the vane. For example, adjacent the first ribbon end 31, the leading ribbon surface 35 can face outwardly in direction O1, generally on the lateral side 23L1 of the base and vane. In contrast, at the second end 32, the leading ribbon surface 35 can face outwardly and direction O2 generally away from the second side surface 23L2. Inclusively, although the leading ribbon surface is disposed at the second end or rear end or trailing end of the vane, it still can be referred to as the leading ribbon surface. The lower ribbon surface 34 can face opposite the direction O1, in direction O2, generally outward from the second lateral side 23L2 at the first end 31 and in direction O1, from the first lateral side 23L1 at the second end 32 of the ribbon strip 30.

As shown in FIG. 4, and as mentioned above, the vane 10 can include a gap G between the ribbon 30 and the base 20. In some cases, a fin 40 can be secured to, and projected upwardly from the base between the first base end 21 and the second base end 22. The fin 40 can project upward from the base intermediate portion 23 and into the gap G between the ribbon strip and the base. The fin can include a first or forward end 41 and a second or rear end 42. These ends can be adjacent respective base and ribbon ends. The fin also can include intermediate portion 43 and an upper fin edge 44. This upper fin edge 44 can be separated a distance D2 from the ribbon strip and the lower ribbon surface 20L. In some cases, the fin 40 can be substantially planar and flat. In other cases, the fan can be of a pre-curled or helical configuration and can be attached to the base, offset to the longitudinal axis LA at one of several angles or along some curve.

The first fin end 41 can be separated from the first ribbon end 31 and likewise the second fin end 42 can be separated from the second ribbon end 32. Respective small secondary gaps can be formed between these respective ends. The ribbon strip 30 at the first end 31 can be substantially parallel to the first end 41 of the fin. Likewise, the second ribbon end 32 can be substantially parallel to the second fin end 42. Between the respective ends, however, the intermediate portion of the fin and the ribbon strip are non-parallel and/or generally offset relative to one another. The upper edge 44 of the fin also can be separated from the lower ribbon surface 34 along a substantial portion of the length of the fin. Near the first fin end 41, the fin edge 44 can face toward the first ribbon side edge 36E1. Near the second fin end 42, that fin edge 44 can face toward the second ribbon side edge 36E2.

The components of the vane and the vane itself can be constructed from a rigid or semi rigid but flexible material. This material can be a polymeric material, natural or synthetic rubber, silicone, a composite material or other material. In some applications, circumstances material can be an alloy or metallic. Generally, the material can retain the general shape of the twisted ribbon strip as an associated arrow is accelerated and flies during flight. The material, however, can withstand the impact of the vane with a bow riser or an arrow rest without permanent deformation so that the vane can be used multiple times and provide similar aerodynamic effects on the arrow to which the vane is attached. Again these aerodynamic effects can include spinning, rotating or otherwise reorienting the projectile to which the vane is attached.

A first alternative embodiment of the vane is illustrated in FIGS. 8-14 and generally designated 110. This vane 110 is similar in structure, function and operation to the vane 10 described in the embodiment above, with several exceptions. For example, this vane 110 includes a base 120 and a ribbon strip 130 that is twisted from its forward end to its rearward end, and virtually identical to the embodiment of the vane 10 above. In this embodiment, however, the fin of the embodiment above is wholly absent. Thus, in the gap G between the base 120 and the ribbon strip 130, there is no other substantial structure, such as a fin.

A second alternative embodiment of the vane is illustrated in FIGS. 16-21, and generally designated 210. This vane 210 is similar in structure, function and operation to the vanes 10 and 110 described in the embodiments above, with several exceptions. For example, this vane 210 includes a base 220 and a twisted ribbon strip 230. The ribbon strip can be of a generally helical configuration. The ribbon strip, however, can be of a substantially uniform width that extends from the first ribbon end 231 to the second ribbon end 232. For example, the width W5 at the first end can be substantially equal to the width W6 in the intermediate portion 233, which can be substantially equal to the width W7 at the second or rearward end 232 of the ribbon strip 230.

Optionally, in this embodiment, the vane 210 can include the ribbon strip 230 with an apex A' that is at or near the middle M' of the length L' of the vane. Thus, the apex A' is generally centered between the first and second ends 231, 232 of the base and the ribbon strip. The distance D3 between the lower ribbon surface 234 and the upper or lower base surfaces to 220U and 220L can be its greatest at or near that middle M' of the length L'.

A third alternative embodiment of the vane is illustrated in FIGS. 22-28 and generally designated 310. This embodiment is similar to the other embodiments above in structure, function and operation with several exceptions. For example, the vane 310 includes a base 320 that is configured to attach to the projectile 100 and its surface 101. This vane 310 includes a ribbon strip 330 that extends rearward from and upward from the base 320. The ribbon strip 330 can include a first end 331 and a second end 332. The second end of this construction, however, is free from attachment to the base and distal from the base, the second end 332 can be cantilevered relative to the base 320 and can extend upward and over, and can be detached from or not otherwise joined with, and/or can be separated from, the surface 101 of the projectile 100 under it. This ribbon strip can be rigid enough so that the intermediate portion and second end are suspended the distance D4 above or away from the surface 101 while the arrow is stationary. In flight, the free end can wobble or pulse, moving toward and away from the surface 101. This ribbon strip 330 also can include a twisted shape so that its leading edge 335 is also twisted rearward of the base 320. This vane also can include a lower ribbon surface 335 that is spaced a variable distance D4 from the lower surface 320L of the base 320, generally in the intermediate ribbon portion 333. The strip can be configured to induce spin to the projectile 100 during flight.

A fourth alternative embodiment of the vane is illustrated in FIGS. 29-34 and generally designated 410. This embodiment is similar to the other embodiments above in structure, function and operation with several exceptions. For example, the vane 410 includes a base 420 that is configured to attach to the projectile 100 and its surface 101. This vane 410 includes a ribbon strip 430 that extends rearward from and upward from the base 420. The ribbon strip 430 can include a first end 431 and a second end 432 that are joined to the base 420. Between the first and the second end, one or more fins 441 and 442 can be disposed under the ribbon strip 430. As shown, there are two fins, but there could be two, three, four or more, depending on their size and aerodynamic effect.

These fins can span between the base and the ribbon, and can connect these elements to one another between the ends of the ribbon. As shown, the first fin can be forward of the second fin, and optionally can be of a shorter or lesser height than the second fin. The first fin can be joined to the upper surface 420U of the base at its bottom and the lower ribbon surface 434 of the ribbon strip at its top. The first fin 441 can be joined with the intermediate portion 433 of the ribbon, closer to the first end 431 of the ribbon than the second fin 442. The second fin can be rearward of the first fin, and of a greater height than the first fin, optionally extending to the apex A of the ribbon. The first fin can be joined to the upper surface 420U of the base at its bottom and the trailing or undersurface 434 of the ribbon strip at its top. The second fin 442 can be joined with the intermediate portion 433 farther rearward than the first fin, and closer to the second end 432 of the ribbon than the first fin 441. Optionally, each of the fins can be integrally formed as a single piece with the ribbon and the base.

Figure 30:
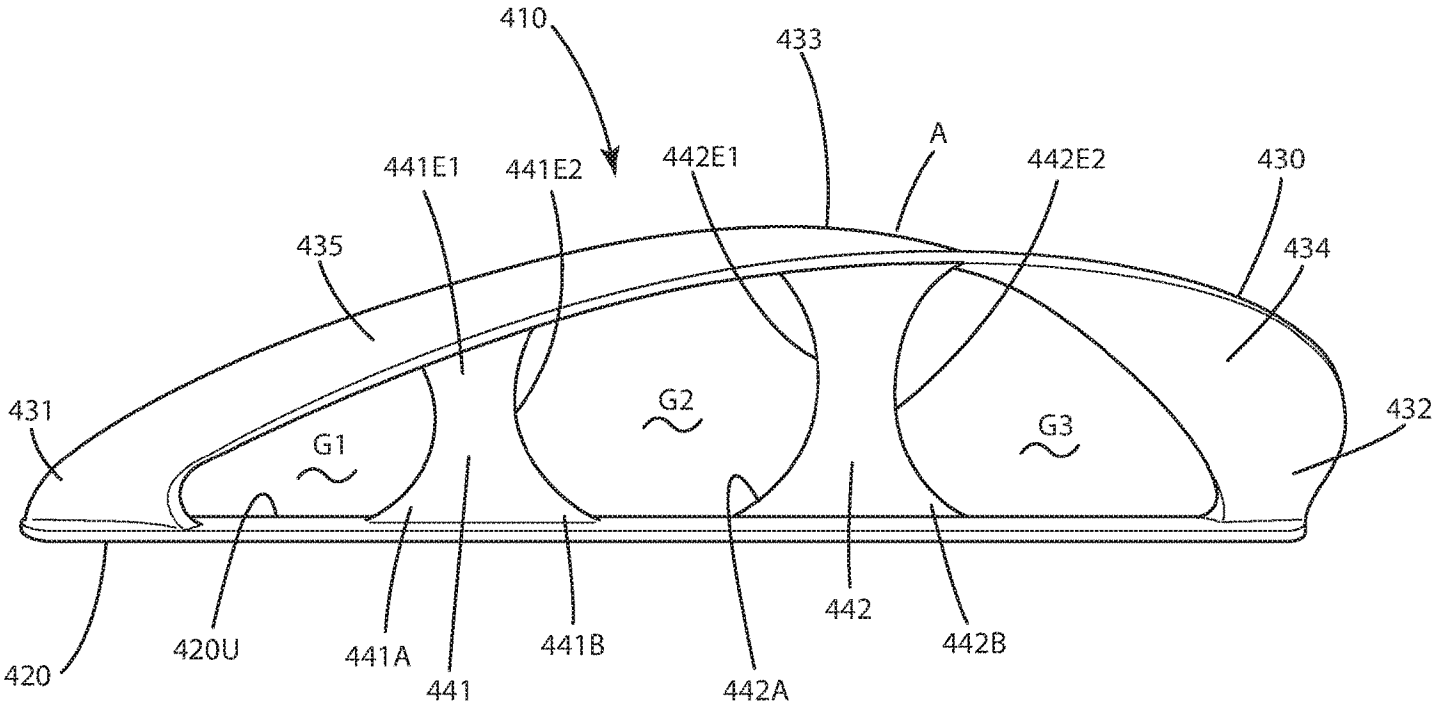
FIG. 30 is a right side view thereof.
Figure 31:
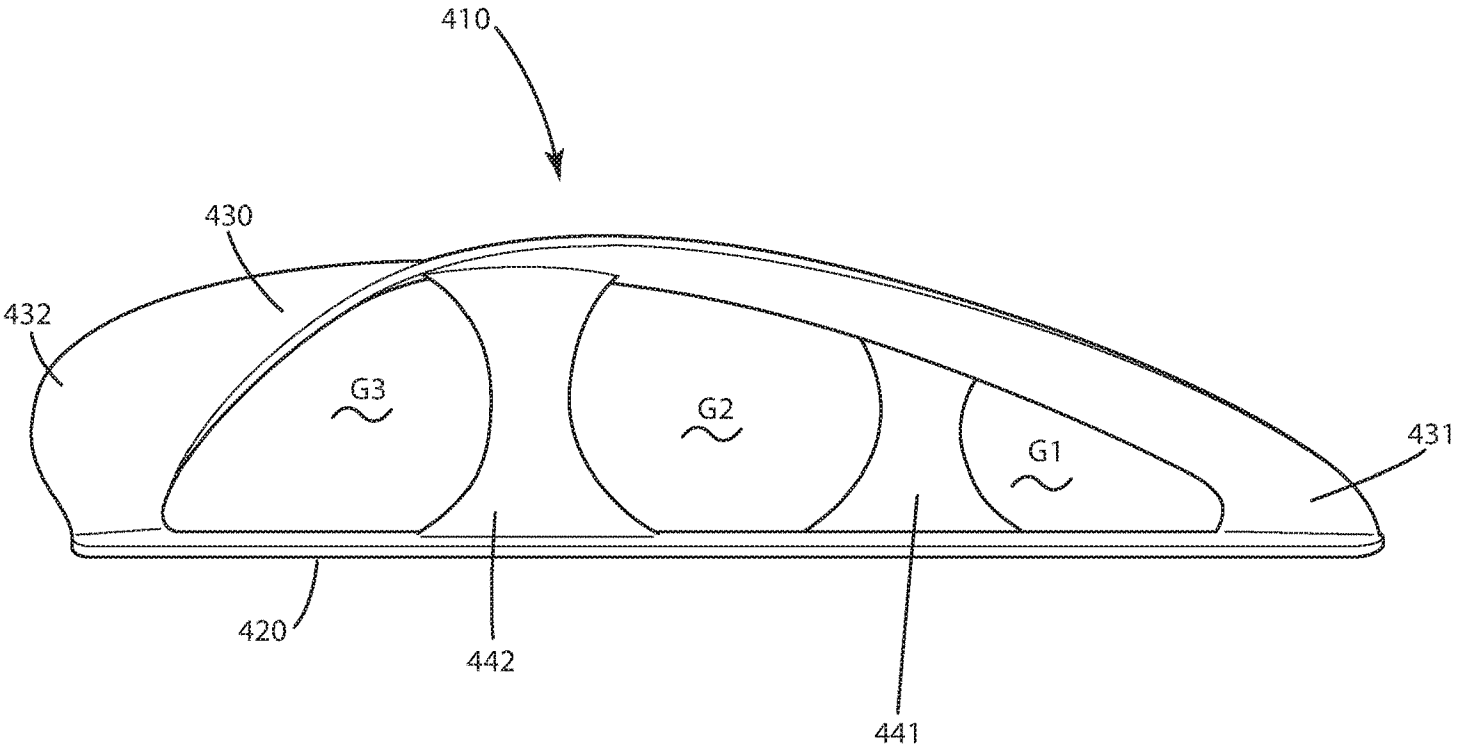
FIG. 31 is a left side view thereof.
Figure 32:
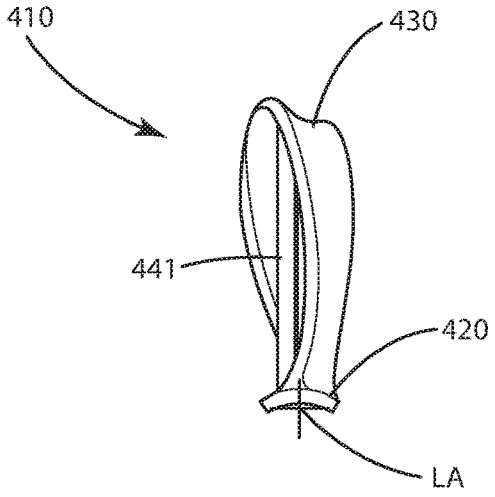
FIG. 32 is front view thereof.

As shown in FIG. 30, the first and second fins can be separated from one another via a gap G2. The gap G2 can span from the ribbon to the base. Another gap G1 can be formed forward of the first fin, and the gap G2 can be formed rearward of the first fin 441. The gap G1 can span from the first end 431 to the first fin 441. Yet another gap G3 can be formed rearward of the second fin 442. The gap G3 can span from the second end 432 to the second fin 442.

Optionally, each of the fins can include front and rear edges. For example, the first or forward fin can include a front 441 E1 and rear 441 E2 edge. The second or rear fin can include a front 442E1 and rear 442E2 edge. These edges can be curvilinear as shown, and can extend from the base to the ribbon. The rear edge 441 E2 can be separated from the front edge 442E1 by the gap G2. These edges in other applications can be generally linear or angled.

Figure 33:
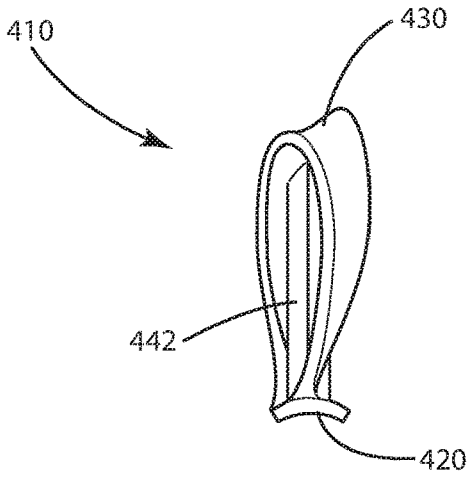
FIG. 33 is rear view thereof.
Figure 34:
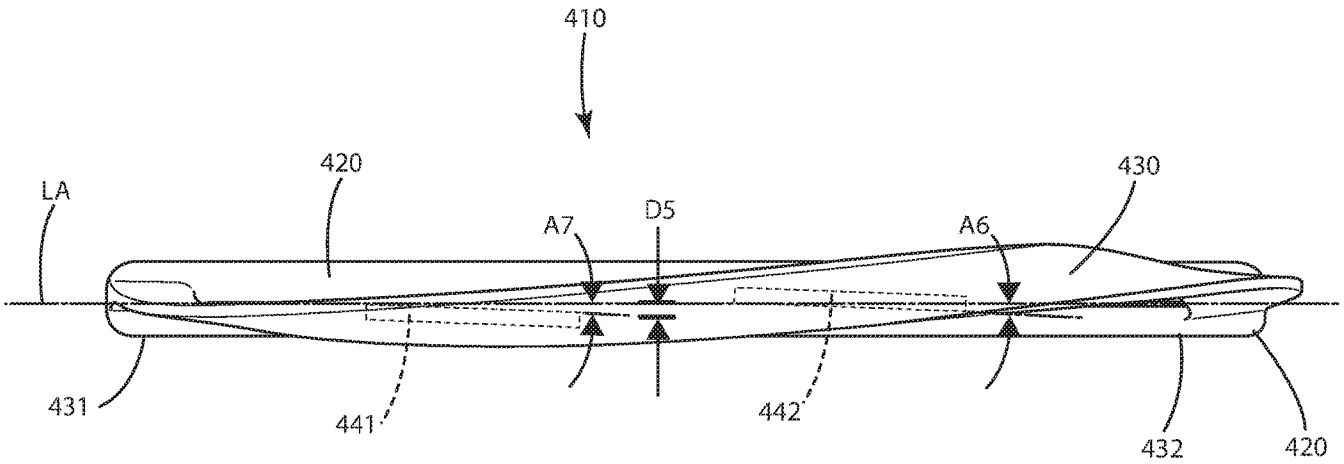
FIG. 34 is a top view thereof.
Figure 35:
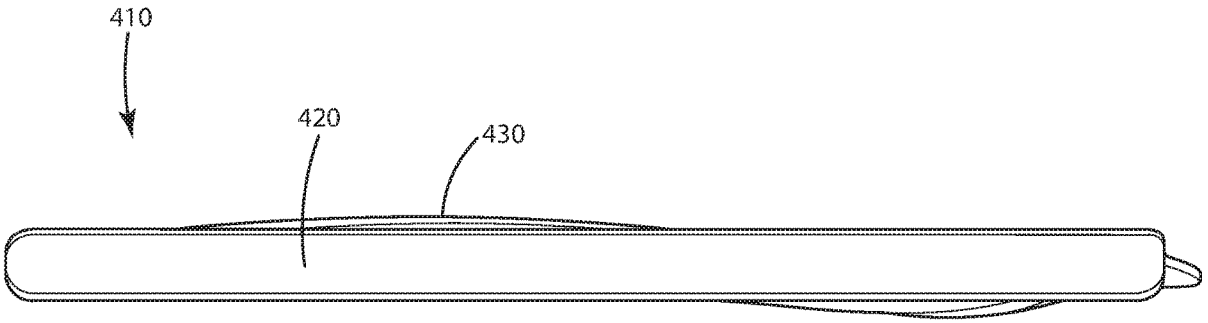
FIG. 35 is a bottom view thereof.

Optionally, the first and second fins, as shown in FIG. 33, can be offset at one or more angles A6, A7 from the longitudinal axis. These angles can be selected to further induce spin to the arrow. The angles A6 and A7 can be equal or unequal. The angles A6 and A7 can be optionally at least 1°, at least 3°, at least 5°, between 1° and 10°, and between 0° and 20°, offset relative to the longitudinal axis LA. Of course, other angles can be selected depending on the application.

As shown in FIG. 33, the fins can both be angled in the same direction, so the rear edge 441 E2 of the first fin is offset a distance D5 from the front edge 442E1 of the second fin. The rear edge 441 E2 can be offset from the longitudinal axis, while the front edge 442E1 can lie on or over the axis LA. This distance D5 can be optionally 0 mm, at least 0.1 mm, at least 1 mm, at least 2 mm, at least 3 mm, at least 4 mm, at least 5 mm, or between 0 mm and 5 mm. Of course, other distances can be selected depending on the application.

Optionally, the fins' front and rear edges might not be offset by any distance at all. In such cases, the remainder of the fins can be offset relative to the longitudinal axis at some angle A6, A7. Further optionally, the remainder of the fins can be offset at angles A6 and A7, but those angles might be zero, in which cases, the fins can be parallel to one another and/or the longitudinal axis. Yet further optionally, the fins can be offset a distance from one another but each still parallel to the other and/or the longitudinal axis. Still further optionally, the first fin can be furled or twisted as it extends upward, so the front edge 441 E1 is twisted or curvilinear as it extends away from the base when viewed from the front view. In some cases, the second fin can have a similar front edge 442E1 configuration. These configurations also can induce spin to the associated arrow.

In operation, the ribbon strip 430 and the fins 441 and 442 can be configured to induce spin to the projectile 100 during flight. Where the fins are offset from one another or at the angles A6 and A7, the fins can further supplement or augment the spin induced by the configuration of the ribbon strip. These fins also can operate as supports or pillars, structurally supporting the leading surface 435 of the ribbon as it undergoes pressure and forces due to air moving over it, to prevent the ribbon from collapsing toward or to the base.

The various components and features of the embodiments herein, for example, the archery vane and its components, can take on a variety of aesthetic forms, shapes and sizes. Although a particular component or feature can have a function, that feature can be expressed in different aesthetic manners to form an artistic design and/or purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A vane configured to mount to a projectile, the vane comprising:

a base including an upper base surface and a lower base surface configured to mount to a surface of a projectile; and a ribbon strip extending upward from the base, the ribbon strip having a leading ribbon surface and a lower ribbon surface, the ribbon strip being semi rigid but flexible, the ribbon strip including a first ribbon end joined with the base, a second ribbon end distal from the first ribbon end, and an intermediate ribbon portion extending rearward from the first ribbon end toward the second ribbon end, the intermediate ribbon portion configured to be spaced a distance from and free from attachment to the surface of the projectile, the ribbon strip including a twist integrally formed therein such that the leading ribbon surface is twisted rearward of the first ribbon end, the lower ribbon surface being spaced a distance above the base in the intermediate ribbon portion, wherein the ribbon strip includes a first edge on a first side of the ribbon strip and a second edge on an opposing second side of the ribbon strip, wherein the first edge faces forward adjacent the first ribbon end, wherein the first edge faces laterally outward in the intermediate ribbon portion, wherein the first edge faces forward, adjacent the second ribbon end, whereby the ribbon strip is configured to induce spin to the projectile during flight of the projectile.

2. The vane of claim 1, wherein the lower ribbon surface extends from a first ribbon side edge to a second ribbon side edge, wherein the lower ribbon surface is configured to face downward toward the surface of the projectile when the vane is mounted to the arrow.

3. The vane of claim 2, wherein the first ribbon side edge is spaced a first height above the lower base surface, wherein the second ribbon edge is spaced a second height above the lower base surface, wherein the second height is greater than the first height.

4. The vane of claim 1, wherein the first ribbon end is attached to a first base end of the base, wherein the second ribbon end is attached to a second base end of the base, wherein the intermediate ribbon portion is spaced a gap away from an intermediate base portion, wherein a pillar projects upward from the base intermediate portion in the gap between the ribbon strip and the base.

5. The vane of claim 1, wherein the base includes a longitudinal axis having a first side and an opposing second side, wherein the leading ribbon surface faces laterally outward on the first side adjacent the first ribbon end, but laterally outward on the opposing second side adjacent the second ribbon end.

6. The vane of claim 5, wherein the second ribbon end is secured to a second base end of the base, wherein the first ribbon end is secured to a first base end of the base.

7. A vane configured to mount to a projectile, the vane comprising:

a base including an upper base surface and a lower base surface configured to mount to a surface of a projectile;

a ribbon strip extending upward from the base, the ribbon strip having a leading ribbon surface and a lower ribbon surface, the ribbon strip being semi rigid but flexible, the ribbon strip including a first ribbon end joined with the base, a second ribbon end distal from the first ribbon end, and an intermediate ribbon portion extending rearward from the first ribbon end toward the second ribbon end, the intermediate ribbon portion configured to be spaced a distance from and free from attachment to the surface of the projectile, the ribbon strip including a twist integrally formed therein such that the leading ribbon surface is twisted rearward of the first ribbon end, the lower ribbon surface being spaced a distance above the base in the intermediate ribbon portion, wherein the second ribbon end is free from attachment to the base, and is configured to be spaced at least the distance from and free from attachment to the surface of the projectile, wherein the projectile is an arrow, whereby the ribbon strip is configured to induce spin to the projectile during flight of the projectile.

8. A vane configured to mount to a projectile, the vane comprising:

a base configured to mount to a surface of a projectile; and a semi-rigid ribbon strip extending upward from the base and including an intermediate ribbon portion configured to be spaced a distance from the surface of the projectile, the ribbon strip including a leading ribbon surface that is twisted rearward of a first ribbon end, wherein the ribbon strip includes a first ribbon edge that twists with the ribbon strip from a forward facing direction to a first lateral facing direction back to the forward facing direction between the first ribbon end and a distal, second ribbon end of the ribbon strip, whereby the ribbon strip is configured to induce spin to the projectile during flight of the projectile.

9. The vane of claim 8, wherein the base includes a first base end and a second distal base end, wherein the base includes a longitudinal axis having a first side and an opposing second side, wherein the leading ribbon surface faces outward from the first side adjacent the first base end, wherein the leading ribbon surface faces outward from the second side adjacent the second base end.

10. The vane of claim 8, wherein the base includes a lower base surface, wherein the ribbon strip includes a second opposing ribbon edge, wherein the second opposing ribbon edge twists in a helical manner with the ribbon from a rearward facing direction to a second lateral direction, opposite the first lateral direction, back to the rearward facing direction between the first and second ends of the ribbon strip.

11. The vane of claim 8, wherein the base includes a longitudinal axis, wherein the ribbon strip includes a second ribbon end rearward of the intermediate portion, the second ribbon end having a second width, wherein the first ribbon end includes a first width, wherein the first width and second width are substantially parallel to the longitudinal axis.

12. The vane of claim 11, wherein the intermediate ribbon portion includes a third width that is substantially perpendicular to the longitudinal axis.

13. A vane configured to mount to a projectile, the vane comprising:

a base configured to mount to a surface of a projectile; and a semi-rigid ribbon strip extending upward from the base and including an intermediate ribbon portion configured to be spaced a distance from the surface of the projectile, the ribbon strip including a leading ribbon surface that is twisted rearward of a first ribbon end, wherein the ribbon strip includes a second ribbon end that is free from attachment to the base, and is configured to be spaced from and free from attachment to the surface of the projectile, wherein the projectile is an arrow, whereby the ribbon strip is configured to induce spin to the projectile during flight of the projectile.

14. A vane configured to mount to a projectile, the vane comprising:

a base configured to mount to a surface of a projectile;

a semi-rigid ribbon strip extending upward from the base and including an intermediate ribbon portion configured to be spaced a distance from the surface of the projectile, the ribbon strip including a leading ribbon surface that is twisted rearward of a first ribbon end; and a fin joined with the base and disposed under the ribbon strip, wherein a segment of the ribbon strip is perpendicular to the fin, wherein the fin includes an upper fin edge that is separated from a ribbon lower surface in the intermediate ribbon portion, whereby the ribbon strip is configured to induce spin to the projectile during flight of the projectile.

15. A vane configured to mount to a projectile, the vane comprising:

a base configured to mount to a surface of a projectile; and a semi-rigid ribbon strip extending upward from the base and including an intermediate ribbon portion configured to be spaced a distance from the surface of the projectile, the ribbon strip including a leading ribbon surface that is twisted rearward of a first ribbon end, wherein the ribbon strip leading ribbon surface is concave across a width extending from a first side edge to a second opposing side edge in the intermediate ribbon portion, whereby the ribbon strip is configured to induce spin to the projectile during flight of the projectile.

16. The vane of claim 15, wherein the base extends rearward under the ribbon strip, with the ribbon strip being free floating above the ribbon strip in the intermediate ribbon portion, but is connected to the base rearward of the intermediate portion.

17. A vane configured to mount to a projectile comprising:

a base mounted to a surface of the projectile;

a semi-rigid ribbon strip extending upward from the base and including an intermediate ribbon portion spaced a distance from the base, the ribbon strip including a leading ribbon surface that is twisted rearward of a first ribbon end, the ribbon strip including a first side edge and a second opposing side edge in the intermediate ribbon portion, the ribbon strip including a lower surface between the first side edge and the second side edge, the first side edge and second side edge each facing laterally outward from a longitudinal axis; and a first pillar extending upward from the base and joined with the lower surface between the first side edge and the second side edge of the ribbon strip, whereby the ribbon strip is configured to induce spin to the projectile during flight of the projectile.

18. The vane of claim 17, wherein the first pillar is disposed adjacent the longitudinal axis, wherein the first pillar is disposed inward from each of the first side edge and the second side edge.

19. The vane of claim 17, wherein the first pillar is distal from the first side edge, wherein the first pillar is distal from the second side edge.

20. The vane of claim 17, comprising:

a second pillar separate and rearward and from the first pillar, the second pillar extending upward from the base and joined with the lower surface between the first side edge and the second side edge of the ribbon strip, wherein the ribbon strip includes a rearward end joined with the base, wherein the second pillar is spaced from the first pillar and the rearward end.

* * * * *